United States Patent [19]

Fogelström

[11] Patent Number: 4,970,837

[45] Date of Patent: Nov. 20, 1990

[54] CHIMNEY COVERING

[76] Inventor: Ingemar Fogelström, Aspvägen 6, S-833 00 Strömsund, Sweden

[21] Appl. No.: 468,861

[22] Filed: Jan. 23, 1990

[30] Foreign Application Priority Data

Jan. 25, 1989 [SE] Sweden ..... 8900259

[51] Int. Cl.[5] ..... E04H 12/28

[52] U.S. Cl. ..... 52/244; 52/58; 52/301

[58] Field of Search ..... 52/202, 244, 300, 301, 52/58; 285/44, 165, 302

[56] References Cited

U.S. PATENT DOCUMENTS

| | | | |
|---|---|---|---|
| 1,442,172 | 1/1923 | Nelson | 52/58 X |
| 1,940,566 | 12/1933 | Schroeder | 52/244 |
| 2,381,178 | 8/1945 | Munyon | 52/244 |
| 2,956,495 | 10/1960 | Sublette | 52/58 X |
| 3,363,369 | 1/1968 | Miller | 52/301 X |
| 4,777,871 | 10/1988 | Stowell | 52/244 X |

FOREIGN PATENT DOCUMENTS 2500872 9/1982 France .

*Primary Examiner*—David A. Scherbel
*Assistant Examiner*—Creighton Smith
*Attorney, Agent, or Firm*—McFadden, Fincham, Marcus & Allen

[57] ABSTRACT

A chimney covering comprises a flashing in the form of at least one metal sheet applicable in the same plane as a sloping roof and provided with a collar, a tubular jacket applicable around a chimney pot, and a tubular connecting piece mountable between the jacket and the collar in such a manner that the lower part of the connecting piece encloses at least parts of the collar while the lower part of the jacket encloses parts of the connecting piece. The jacket has an upper end extending at right angles to the longitudinal axis of the jacket while the lower end thereof is obliquely cut at an angle of about 45°. The connecting piece has a first end extending at right angles to the longitudinal axis of the connecting piece while the opposite end thereof is obliquely cut at an angle of preferably 22.5°. The connecting piece is adapted to be turned with the above-mentioned first end facing downwards for small roof slopes and with the above-mentioned second end facing downwards for large roof slopes.

2 Claims, 3 Drawing Sheets

Figure 1:
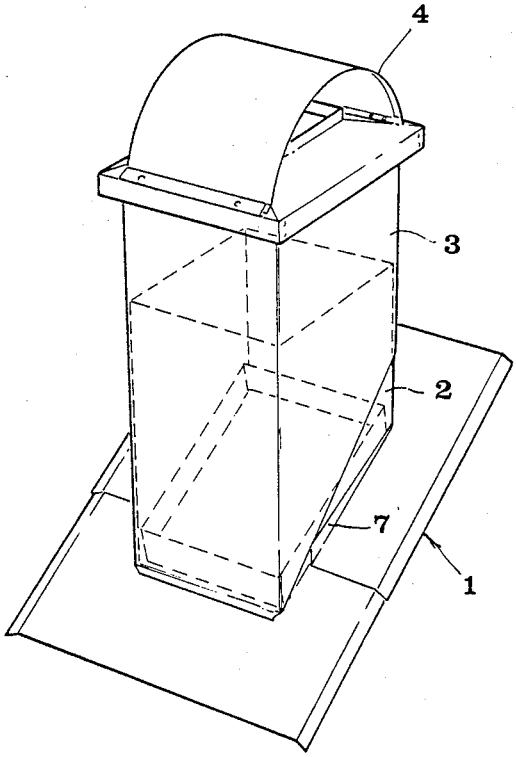

Fig 8
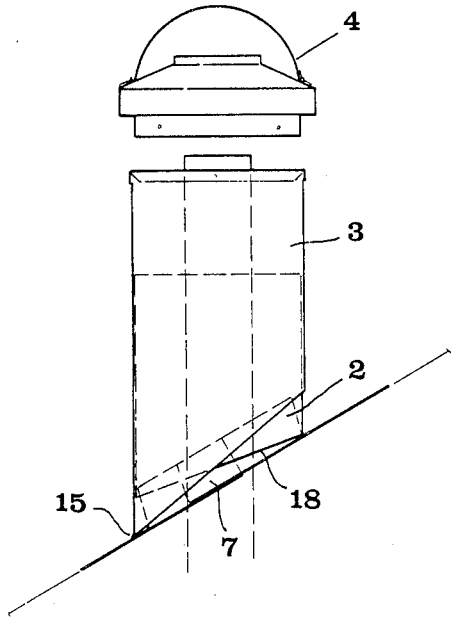
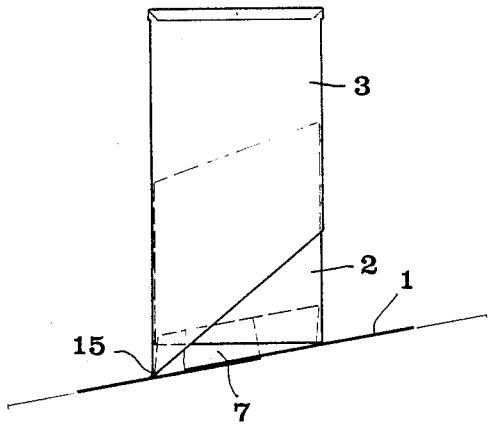
Fig 7
Fig 9
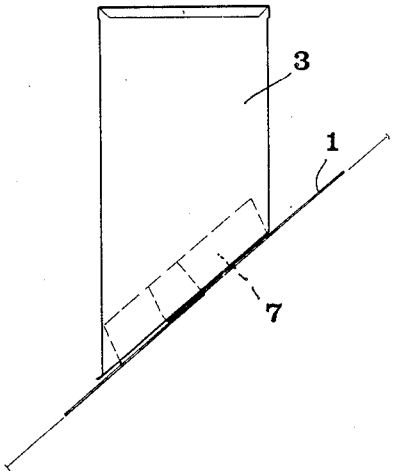

CHIMNEY COVERING

TECHNICAL FIELD OF THE INVENTION

This invention relates to a chimney covering of the type comprising a flashing in the form of at least one metal sheet applicable in the same plane as a sloping roof and having a collar defining an opening for a chimney pot and projecting a limited distance at an angle to the rest of the flashing, a tubular jacket applicable around the chimney pot, and a tubular connecting piece mountable between said jacket and said collar in such a manner that the lower part of the connecting piece encloses at least parts of said collar while the lower part of said jacket encloses parts of said connecting piece.

STATE OF THE ART

From SE Design Registration No. 34,123 is previously known a chimney covering of the type stated above. In this prior art covering, both the upper and the lower end of the jacket are cut at right angles to the longitudinal axis of the jacket while the connecting piece has an upper end also extending at right angles to the longitudinal axis, whereas the lower end of the connecting piece is obliquely cut. This construction serves its purpose for many existing roof slopes, but when the slope of the roof approaches 45°, it is no longer useful unless the lower end of the connecting piece is specially shaped on the spot, more specifically by cutting the lower end of the connecting piece at an angle corresponding to the roof slope concerned. This is a working operation which notably delays and makes the mounting of the entire chimney covering more expensive. Another drawback of the known covering design is that the front edge of the lower end of the jacket, i.e. the end edge which is facing the eaves of the roof and therefore is visible from the ground, will always be located some distance up on the front face of the connecting piece irrespective of the roof slope, this having an adverse effect on the appearance of the entire chimney covering.

BRIEF DESCRIPTION OF THE INVENTIVE CONCEPT

The present invention aims at overcoming the above-mentioned drawbacks of the prior art chimney covering and providing a covering that can be used for all existing roof slopes of between 0° and 45° without necessitating any special cutting or shaping. According to the invention, this is achieved in that said jacket has an upper end extending at right angles to the longitudinal axis of the jacket while the lower end thereof is obliquely cut, and that a first end of said connecting piece extends at right angles to the longitudinal axis of the connecting piece while the opposite, second end thereof is obliquely cut at an angle which is smaller than and suitably substantially half the oblique cutting angle of said lower end of said jacket, said jacket being adapted to always be applied with its longest side in front of the chimney pot while said connecting piece is adapted to be oriented with said first end facing downwards for small roof slopes and with said second end facing downwards for large roof slopes.

In a preferred embodiment of the invention, the lower end of the jacket is obliquely cut at an angle of about 45° while the oblique cutting angle of said second end of said connecting piece is in the range of 20°–25°, suitably about 22.5°.

BRIEF DESCRIPTION OF THE ACCOMPANYING DRAWINGS

Figure 3:
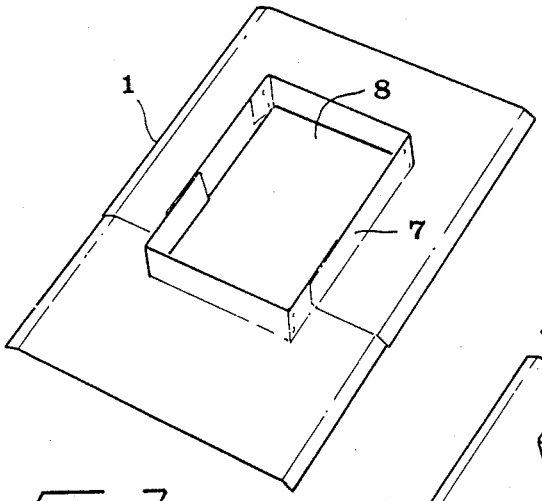
Figure 2:
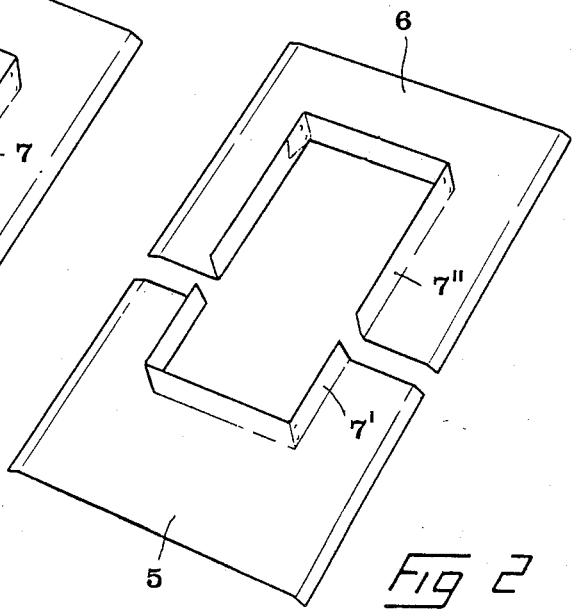
Figure 4:
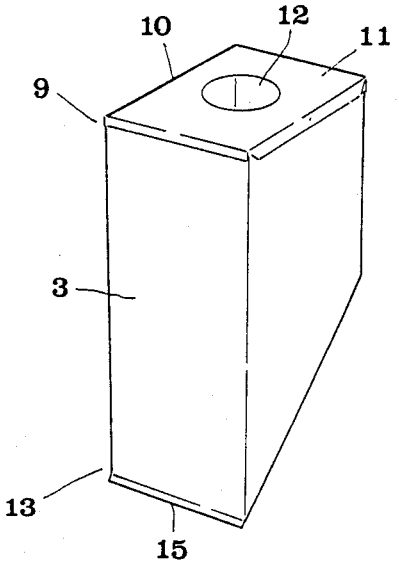
Figure 5:
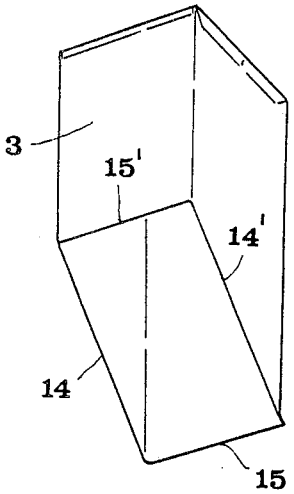
Figure 6:
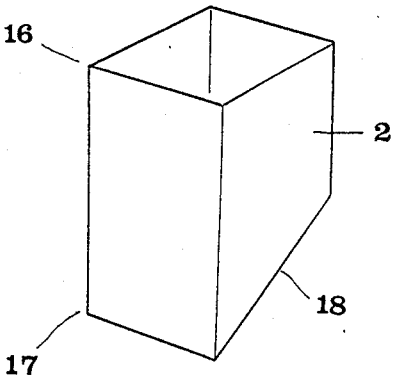

In the drawings,

FIG. 1 is a perspective view of the inventive chimney covering when assembled, FIG. 2 is a perspective view of two metal sheets which together form a flashing being part of the covering, FIG. 3 is a perspective view of the same metal sheets as in FIG. 2, however in the assembled state, FIG. 4 is a perspective view of a jacket being part of the covering, as seen obliquely from above, FIG. 5 is a perspective view showing the same jacket obliquely from below, FIG. 6 is a perspective view illustrating a connecting piece included in the jacket, and FIGS. 7–9 are side views showing the use of the chimney covering at different roof slopes.

DETAILED DESCRIPTION OF A PREFERRED EMBODIMENT OF THE INVENTION the chimney covering shown in FIG. 1 comprises a flashing generally designated 1, which is applicable in the same plane as a sloping roof, a connecting piece 2, a jacket 3 and, mounted thereon, a top or cowl 4 for keeping the rain off. As appears from FIGS. 2 and 3, the flashing 1 is composed of two separate metal sheets 5, 6, both having upwardly projecting metal portions 7', 7'' which together form a collar 7 when the sheets 5, 6 have been placed adjacent each other with one sheet overlapping the other. The collar 7 then defines a rectangular opening 8 in the flashing formed by the sheets 5, 6. Since the sheets 5, 6 are displaceable relative to each other, the size of the opening 8 can be adjusted to different types of chimney pots before the sheets are finally secured to the roof structure, e.g. by bolts passing through the overlapping portions of the sheets.

As appears from FIGS. 4 and 5, the jacket 3 has an end 9 which is always facing upwards and at which all four walls of the jacket are cut at right angles to the longitudinal or centre axis of the jacket. This upper end of the jacket can be provided with a guide plate 11 having a central circular opening 12 of the same diameter as the diameter of a chimney pipe rising from a roof and to be covered by the chimney covering. The lower end 13 of the jacket, however, is obliquely cut, more specifically in such a manner that the lower edges 14, 14' of the two opposite side walls of the jacket extend at an angle of 45° to the longitudinal axis of the jacket, whereas the lower edges 15, 15' of the front wall and the rear wall of the jacket, respectively, extend at right angles to said axis.

Similarly, a first end 16 of the connecting piece 2 extends at right angles to the longitudinal axis of the connecting piece whereas the opposite, second end 17 thereof is obliquely cut, more specifically at an angle which is smaller than the oblique cutting angle of the jacket 3. In practice, it is preferred that the lower edges 18 of the side walls of the connecting piece are obliquely cut at an angle which is substantially half the oblique cutting angle of the jacket that is about 22.5°, although it is sufficient with an angle in the range of 20°–25°.

FUNCTION AND USE OF THE INVENTIVE COVERING

In FIGS. 7–9, the inventive chimney covering is applied to roofs having different slopes. Thus, FIG. 7 shows a roof having an extremely small slope. In this case, the connecting piece 2 is applied outside the collar 7 of the flashing 1, with the first orthogonal end 16 of the connecting piece facing downwards and the obliquely cut end of the connecting piece facing upwards, the jacket 3 being passed over the connecting piece 2, more specifically in such a manner that the lower edge 15 of the longest rectangular wall of the jacket is facing forwards or in the direction of the eaves so that this very wall becomes visible from the ground.

The roof in FIG. 8 has a considerably steeper slope than the roof in FIG. 7, e.g. about 30°. In this case, the connecting piece 2 is turned with its obliquely cut end 17 facing downwards so as to cover the side portions of the collar 7, which would not have been possible with the orthogonal end facing downwards. Otherwise, the jacket 3 is applied in the same way as in FIG. 7, i.e. with the obliquely cut end facing downwards and the lower edge 15 of the longest wall of the jacket facing in the direction of the eaves.

FIG. 9, finally, shows an embodiment in which the roof has an extremely steep slope, viz. about 45°. In this case, the connecting piece 2 can be entirely dispensed with and the jacket 3 applied directly outside the collar 7 of the flashing 1.

From the above appears that it is possible with the chimney covering according to the invention to cover the collar 7 of the flashing 1 at all existing roof slopes in the range of 0°–45° without the need of any special cutting of any parts of the covering. Thus, the connecting piece illustrated can be readily and conveniently mounted so as to cover the collar of the flashing by being turned with its orthogonal end facing downwards for small roof slopes and with its obliquely cut end facing downwards for steeper roof slopes, whereby the clearance between the sheets 5, 6 of the flashing and the lower jacket edges 14, 14', always cut at an angle of 45°, is in all cases covered by the connecting piece, independent of the roof slope.

It should also be mentioned that in practice, the cowl 4 shown in FIG. 1 may advantageously be provided with downwardly opening slots to bring about a ventilation effect through the cowl when smoke from the chimney pipe passes therethrough.

What I claim and desire to secure by Letters Patent is:

1. Chimney covering of the type comprising a flashing in the form of at least one metal sheet applicable in the same plane as a sloping roof and having a collar defining an opening for a chimney pot and projecting a limited distance at an angle to the rest of the flashing, a tubular jacket applicable around the chimney pot, and a tubular connecting piece mountable between said jacket and said collar in such a manner that the lower part of the connecting piece encloses at least parts of said collar while the lower part of said jacket encloses parts of said connecting piece, wherein said jacket has an upper end extending at right angles to the longitudinal axis of the jacket while the lower end thereof is obliquely cut, and wherein a first end of said connecting piece extends at right angles to the longitudinal axis of the connecting piece while the opposite, second end thereof is obliquely cut at an angle which is smaller than and suitably substantially half the oblique cutting angle of said lower end of said jacket, said jacket being adapted to always be applied with its longest side in front of the chimney pot while said connecting piece is adapted to be oriented with said first end facing downwards for small roof slopes and with said second end facing downwards for large roof slopes.

2. Covering as claimed in claim 1, wherein said lower end of the jacket is obliquely cut at an angle of about 45°, and the oblique cutting angle of said second end of said connecting piece is in the range of 20°–25°, suitably about 22.5°.

* * * * *